United States Patent [19]

Boyer et al.

[11] 4,099,710

[45] Jul. 11, 1978

[54] RADIAL ROLL FOLDER

[75] Inventors: Harold E. Boyer, Anna; Jerry V. Trisler, Sidney, both of Ohio

[73] Assignee: Graphics Equipment International Corporation, Chicago, Ill.

[21] Appl. No.: 713,323

[22] Filed: Aug. 10, 1976

[51] Int. Cl.[2] ..... B65H 45/14

[52] U.S. Cl. ..... 270/68 A; 270/67; 270/76

[58] Field of Search ..... 270/68 R, 68 A, 20, 270/71–77, 61 R, 65; 29/114–116; 72/233

[56] References Cited

U.S. PATENT DOCUMENTS

| | | | |
|---|---|---|---|
| 2,847,209 | 8/1958 | Olson | 270/68 A |
| 3,211,448 | 10/1965 | Stoothoff | 270/68 A |
| 3,328,026 | 6/1967 | Bartizal | 270/68 A |

*Primary Examiner*—Edgar S. Burr
*Assistant Examiner*—A. Heinz
*Attorney, Agent, or Firm*—Griffin, Branigan and Butler

[57] ABSTRACT

A folding machine includes movable or adjustable rollers, or rolls, each of which forms nips with two fixed rollers. The movable rollers have freedom of movement substantially circumferentially about the two fixed rollers substantially on projected radii of the two fixed rollers, to set the spacings between the fixed and the movable rollers.

The mechanism for supporting and adjusting the movable rollers includes levers pivoted at the axes of the fixed rollers having contoured mounting surfaces. The contoured mounting surfaces are rounded substantially on projected radii of the surfaces of the respective fixed rollers. The shafts of the movable rollers ride on the contoured surfaces.

Automatic adjustment of the spacing between the movable rolls and the fixed rolls is provided by cams which operate on the levers to hold them in specific "spacing" relationships once paper stock has been run between the movable to fixed rolls to move the movable rollers a desired distance from the fixed rollers.

18 Claims, 11 Drawing Figures

RADIAL ROLL FOLDER

BACKGROUND OF THE INVENTION

This invention relates to folding machines; and, more particularly, to a mechanism for adjusting the spacing between fold-rollers thereof.

A preferred form of the invention is embodied in a buckle-type folder. In this respect, a conventional buckle folder is schematically illustrated in FIG. 1 of the drawings. Therein, a fixed roller, or roll, F has five relatively movable or "floating" rollers associated therewith. That is, all of the rollers are journalled in a frame, not shown, but roller a is pivotably adjustable about point 10 by an adjusting means schematically illustrated as 12 in order to adjust a first "nip" space indicated by arrow 1. Roller b is similarly adjustable with respect to the fixed roller F in order to adjust the "nip" space indicated by arrow 2; roller c is adjustable with respect to roller b in order to adjust the nip space indicated by arrow 3; roller d is adjustable with respect to roller c in order to adjust the nip space indicated by arrow 4; and so on.

It should be noted, with respect to the above described conventional folder, that since only roller F is fixed, errors in adjusting subsequent rollers are culmulative.

In operation, when a sheet of paper, such as P in FIG. 1, is to be folded it is fed between the fixed roller and the first roller a until it strikes a stop S in a first fold pan 14. The paper then buckles downwardly as shown at P-2 into the "nip" illustrated by arrow 2 between the fixed roller F and the second movable roller b. The paper is then fed and buckled in seriatim into fold pan 16; between movable rollers b and c; into fold pan 18; between movable rollers c and d; and so on.

From the above description, it can be seen that the sheet P is folded over and over again so that the stock thickness passing between successive rollers gets larger and larger. In this respect, each of the movable rolls *b–e* is conventionally separately adjustable by a lever and spring arrangement similar to the structure such as 12 associated with the first movable roller *a;* and, moreover, each movable roll has a similar lever-spring structure located on each of its ends. Additionally, it should be noted that adjustment of one of the movable rollers such as b, in order to change the nip space indicated by arrow 2, conventionally results in an alteration of a nip space indicated by arrow 3 and so on.

Finally, before turning to the structure of the invention, it should be appreciated that the various rollers are conventionally gear-driven. Since the position of each of the movable rollers is dependent upon another, however, the customary gear train between the rollers cannot satisfactorily drive or be driven on their "pitch diameters." Hence, not only is there a resulting loss in efficiency, but the gears run quite noisily; and, the drive-power requirements become disproportionately larger with each additional movable roller that is added to the train.

It is a fundamental purpose of the instant invention to provide an improved roller adjusting mechanism for a folding machine wherein it is not necessary to manually adjust individual rollers. In this respect, a preferred embodiment of the invention will be described shortly; and, that preferred embodiment has additional advantages over a conventional fold-roller adjusting mechanism such as that described above. That is, when one of the preferred embodiment's movable rollers is adjusted in order to change the nip-space between two rollers, there is no change in the nip-space between that movable roller and another adjacent roller. Also, by reducing the number of movable rollers that are required, the illustrated embodiment eliminates the previously troublesome cumulative adjustment error; permits several of the rollers to be driven on their pitch diameters so as to increase efficiency; and, reduces power requirements and noise.

Additionally, as the speed of the above described conventional folder increases, the torques applied to the various rollers tend to urge them toward each other so that the high-speed nip-spaces become too small. Hence, it is customary for a skilled operator to provide oversize nip-spaces at low speeds so that the machine will operate properly at high speeds. The embodiment of the invention about to be described, however, does not have this disadvantage.

Still further, if narrow stock is folded in a conventional machine, it is difficult to properly adjust the nip spaces because they are preferably different on one side of the machine than on the other. Similarly, as a conventional machine's rollers wear, it is desirable to take such wear into account when the machine's nip spaces are adjusted for each different type of stock thickness and size that is run through the machine. As will be appreciated from the following description, however, the illustrated embodiment of the invention has an additional advantage of automatically adjusting the nip spaces to account for stock size and thickness and roller-wear.

SUMMARY OF THE INVENTION

According to principles of this invention, a movable roller of a folding machine is "radially", or circumferentially, movable about two adjacent fixed rollers. To achieve this, a movable-roller shaft rides on contoured surfaces located at opposite ends of the fixed rollers. The movable roller is biased toward the contoured surfaces to remain in contact therewith. The contoured surfaces are rounded as defined by projected radii of the fixed rollers.

The contoured surfaces are made movable to follow the movable-roller shafts when they are "spaced" from the fixed rolls and to thereafter hold their positions. Thus, the "spacing" of the movable rollers can be set by merely introducing paper stock in the nips formed by the movable rollers and the fixed rollers. In this respect, when the spacing is thusly set by placing paper in a nip, movement of a movable roll to accommodate this paper stock is circumferential about an adjacent, upstream, fixed roll, thus, the spacing between the movable roll and the upstream fixed roll (which was previously set) is not thereby changed.

To accomplish this, the contoured surfaces for the upstream roll are pivoted at the axis of the adjacent downstream fixed roll. Cams operate on opposite ends of levers to move the levers so that the contoured surfaces can follow the movable roller, but prevent the levers from counterrotating so that the movable roller does not return to its original position.

BRIEF DESCRIPTION OF THE DRAWINGS

The foregoing and other objects, features, and advantages of this invention will be apparent from the more particular description of a preferred embodiment thereof as illustrated in the accompanying drawings wherein the same reference numerals refer to the same elements throughout the various views. The drawings are not necessarily intended to be to scale. Indeed, they are intended to be merely schematic so as to illustrate the principles of the invention in clear form.

In the drawings.

DETAILED DESCRIPTION

Figure 3:
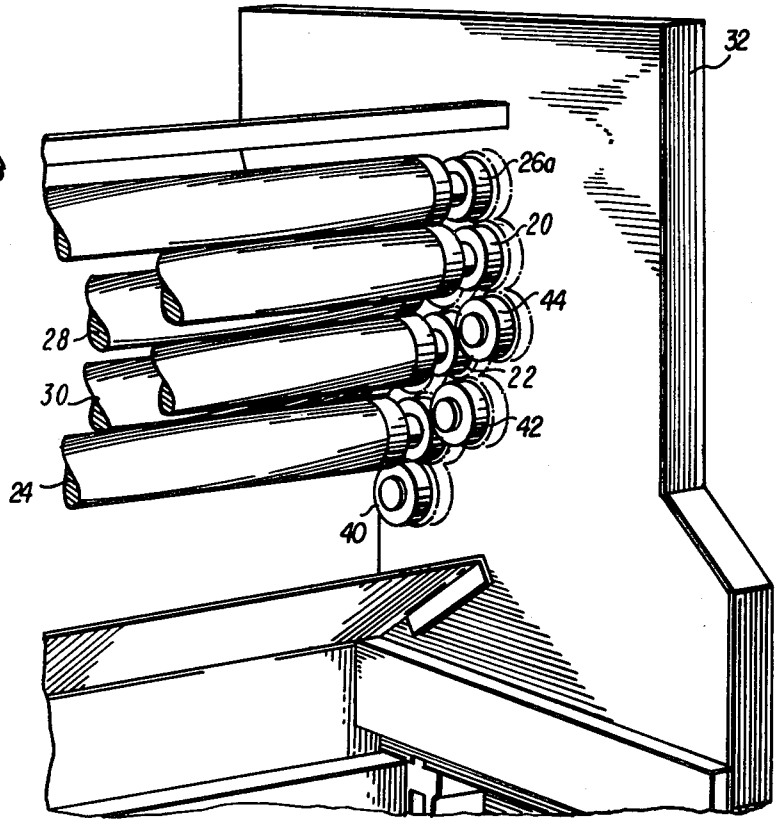
FIG. 3 is a pictorial view of a series of rollers mounted in a folding machine which includes a preferred embodiment of the invention.
Figure 2:
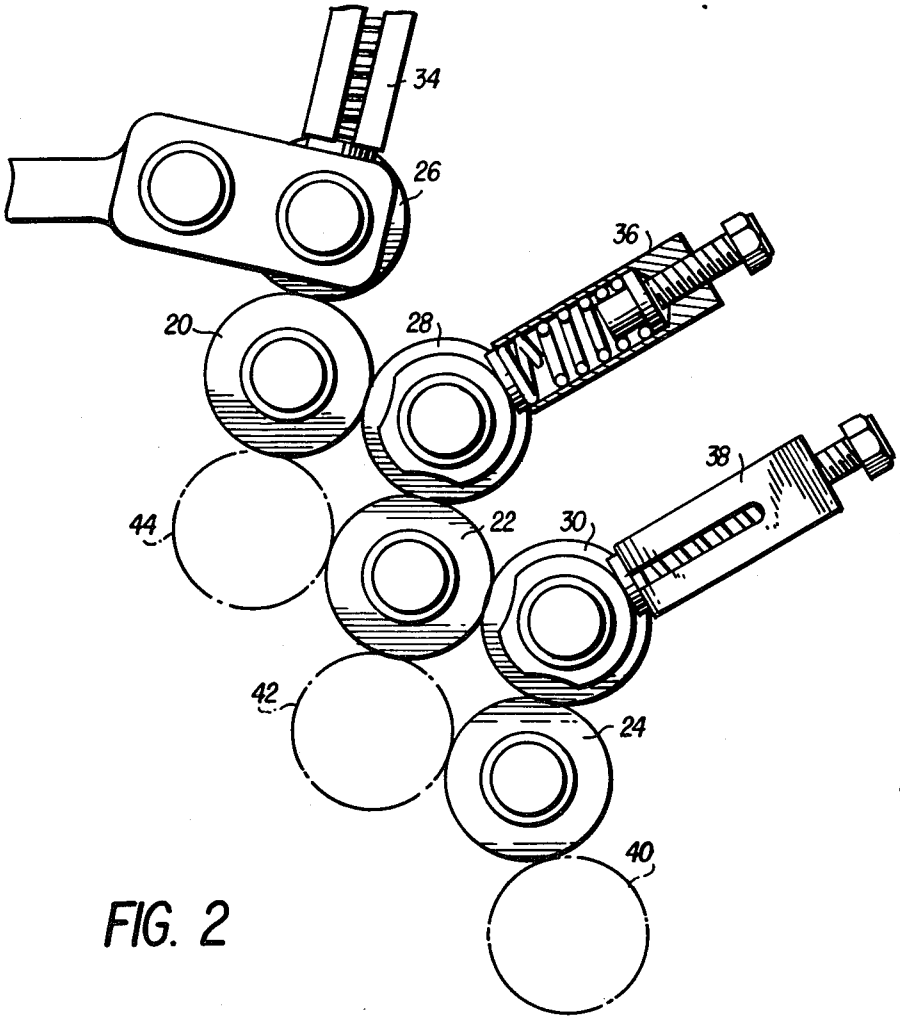
FIG. 2, is a schematic end-view of rollers located in a preferred embodiment of the instant invention.

Many features of an aspect of the invention can be appreciated from FIG. 2 which schematically illustrates three fixed rollers 20, 22 and 24; and, adjacent movable rollers 26, 28 and 30. That is, the fixed rollers are simply journalled in end plates such as 32 in FIG. 3; and, the movable rollers are movably journalled in the end plate 32 against the bias of spring mechanisms 34, 36 and 38.

Fixed roller 24 is driven by a drive-gear 40 which, in turn, is driven by a suitable means not shown; and, fixed rollers 22 and 20 are, in turn, driven by idler gears 42 and 44. In this regard, each of the fixed rollers 20, 22 and 24 and the gears 40, 42 and 44 mesh on their pitch diameters. The movable rollers 26, 28 and 30, however, operate as idler rollers and are driven about 0.015 inches or so off of the pitch diameters of related gears 26*a*, 28*a*, and 30*a* thereof. The use of the fixed rollers driven on their pitch diameters, however, results in a folding machine that is considerably more quiet and efficient than conventional folders; and, therefore, the power requirements are significantly less.

The above described movable rollers are free to position themselves in relation to the fixed rollers in accordance with the thickness of the stock that is fed through the related nip spaces. As will now be described in connection with FIGS. 4, 5 and 6, however, motion of a movable roller during adjustment of a given nip-space does not affect the space between that movable roller and the other adjacent fixed roller.

Figure 4:
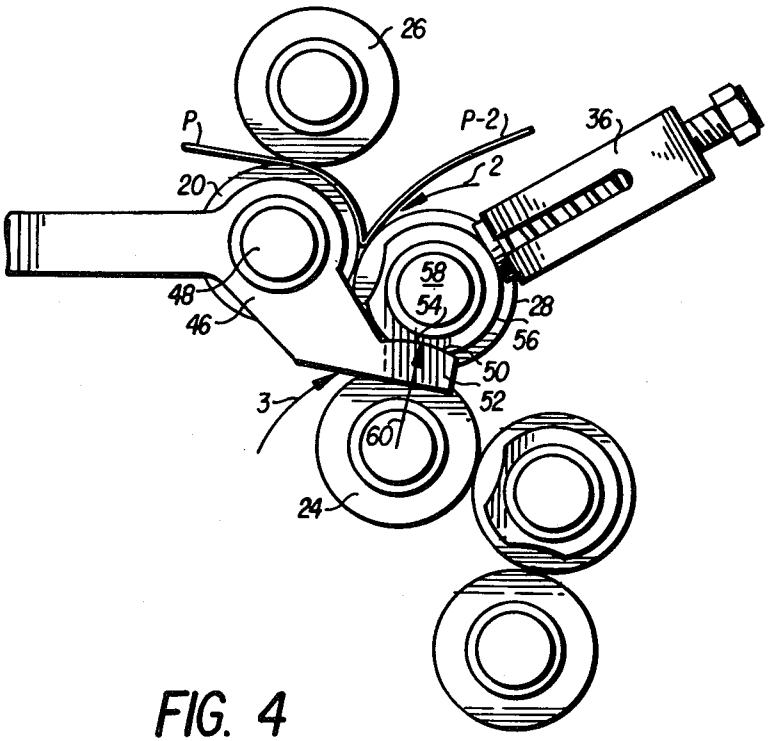
FIG. 4 is a schematic end-view of a roller bank similar to FIG. 2, but including a mechanism for adjusting the nip-space between a first fixed roller and a given movable roller.

As a piece of stock P is fed between rollers 28 and 20 in FIG. 4, for example, the nip space indicated by arrow 2 is adjusted to the double stock thickness by motion of roller 28 against the bias of its spring 36. Lever members 46 (only one shown) mounted on shaft 48 at opposite ends of roller 20, however, have contoured radial portions 50 on second arms 52 (one shown) thereof in engagement with a similarly contoured portions 54 of sleeve 56 mounted on the shaft 58 of the movable roller 28. In this regard, when in a neutral position where the movable and fixed rollers are approximately in contact, the contours 50 and 54 are on an extended radius 60 of the fixed roller 24. Consequently, motion of roller 28 with respect to roller 20 is always approximately along an extension of a radius of roller 24 so that adjustment of the nip-space 2 has no effect upon the nip-space 3. It will be understood that as the contour 50 moves away from the axis of the fixed roller 24, as is explained below, its radius is not identical to an extension of the radius of the fixed roller 24, however, the difference is quite small and can be tolerated.

Figure 5:
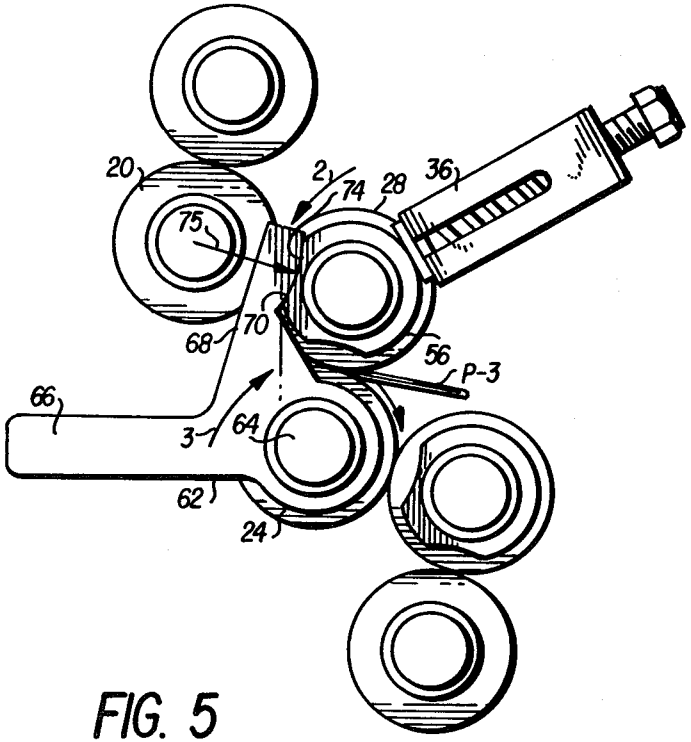
FIG. 5 is also a schematic end-view of a roller bank similar to FIG. 2, but includes a mechanism for adjusting the nip-space between the given movable roller and a second fixed roller.

Similarly, as shown in FIG. 5, a lever member 62 --hereinafter these levers will be spoken of in the singular for simplicity, although it should be understood that there are complementary levers with contoured surfaces located at opposite ends of the rollers — is mounted on shaft 64 of roller 24 so that a first lever arm 66 extends outwardly as shown and a second lever arm 68 has a contoured portion 70 thereof in contact with a similarly contoured portion 74 on the sleeve 56. The contours 70 and 74 are on an extended radius 75 of roller 20. Hence, when the four-folded piece of stock P-3 in FIG. 5 passes through nip-space 3 between rollers 28 and 24, the nip-space 3 is adjusted by motion of the roller 28 against its bias-spring 36, but such motion has no meaningful effect upon the previously adjusted space between rollers 28 and 20.

Figure 6:
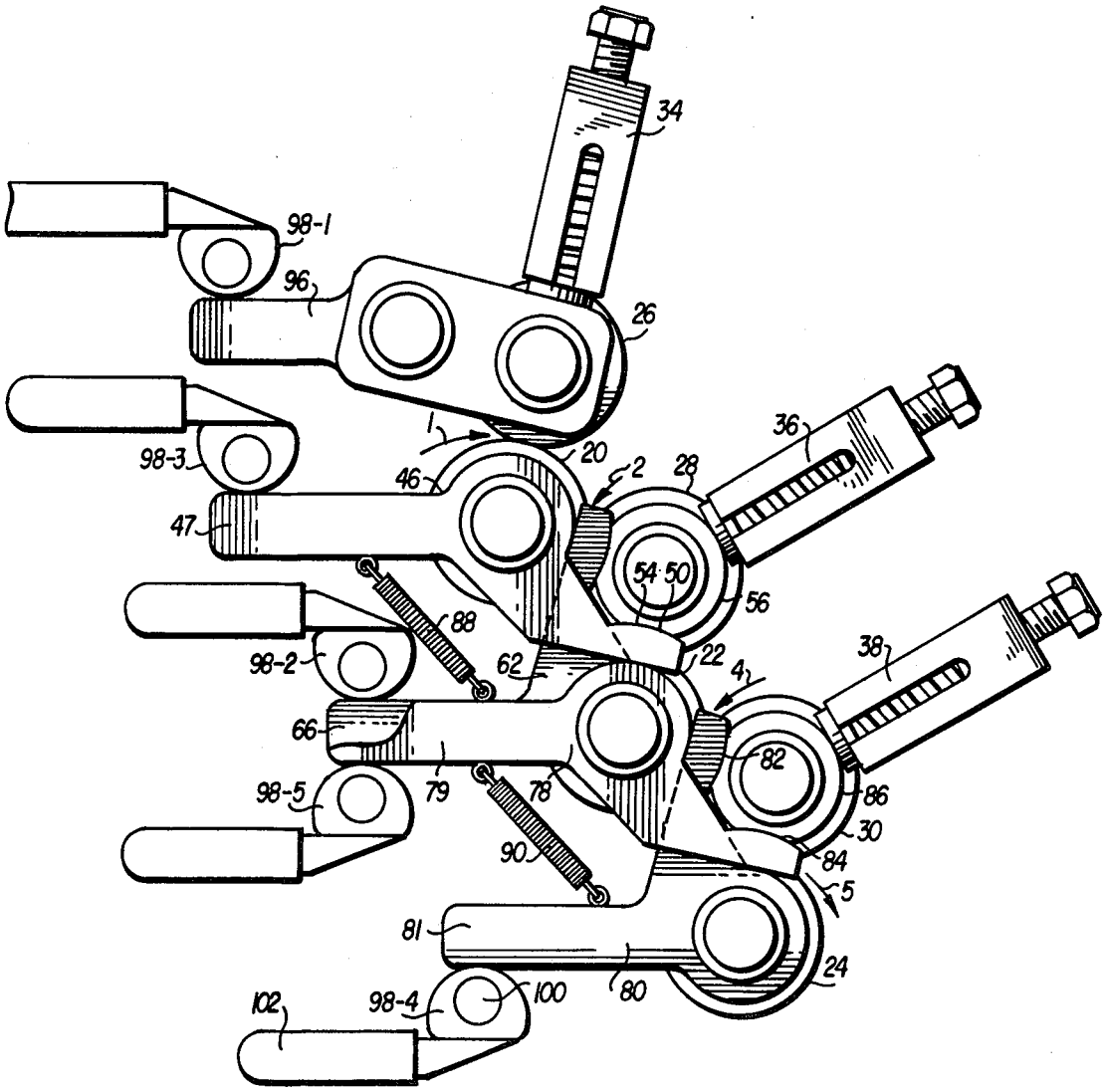
FIG. 6 is a schematic end-view of a roller bank including mechanism for adjusting the nip-spaces between the rollers thereof.

Similar lever members 78 and 80 in FIG. 6 permit nip-spaces 4 and 5 to be adjusted by motion of the movable roller 30 with respect to fixed rollers 22 and 24. Again, however, contours 82 and 84 mate with similar contours of sleeve 86 on roller 30 so that motion of roller 30 to adjust nip-space 4 has no effect upon nip-space 5; and, motion of roller 30 to adjust nip-space 5 has no effect upon nip-space 4.

As shown in FIG. 6, the lever members 46 and 62 are joined by a tension spring 88; and, the lever members 78 and 80 are joined by a tension spring 90. In this manner, the contoured surfaces such as 50 are maintained in engagement with their corresponding surfaces such as 54 on the sleeves 56 and 86. Hence, as a piece of stock is fed in seriatim between the nip-spaces 1 through 5, the movable rollers 26, 28, and 30 move against their respective bias springs 34, 36, and 38, but always along an arc generated by an extended radius of the fixed roller associated with the nip-space being adjusted at any given time. The exception of roller 26, of course, is apparent and will not be discussed.

Each of the first lever arms 47, 66, 79 and 81; and, a lever arm 96 associated with roller 26 has an associated cam element 98-1, 98-2, 98-3, 98-4, and 98-5. These cam elements act as contoured-surface control means and are lockably pivotable about shafts such as 100 associated with cam surface 98-4; and, have weighted arm-members such as 102, also associated with cam surface 98-4.

In operation, in order for the various nip-spaces to be automatically adjusted, the cam surfaces 98 are locked by an unlocking means, not shown in FIG. 6 (but see description of FIG. 9) so that the cams and weighted handles 102 are free to rotate about their mounting shafts 100. A piece of stock is then fed through nip-space 1. As movable roller 26 is thusly moved away from fixed roller 20, lever arm 96 moves a corresponding distance downwardly; and, cam surface 98-1 is rotated by its weighted handle in a counterclockwise direction to engage the surface of lever arm 96. The cam surface 98-1 is held in this position by tension caused by the spring mechanism 34.

As the folded stock next progresses through nip-space 2, roller 28 is moved away from roller 20 by a distance corresponding to twice the stock thickness. As noted above, this motion of roller 28 is along the surface 50 and lever arm 66 is moved upwardly where it is followed by cam surface 98-2.

Substantially the same operation is followed in seriatim as the stock is passed between successive rollers. That is, the nip-spaces 3, 4, and 5 are successively adjusted and the cam surfaces 98-3, 98-4, and 98-5 are brought into engagement with the corresponding lever arms 47, 80 and 79 in their new positions. Finally, after the stock has been fully folded and passed from the machine, the cams 98 are again locked on their shafts 100 so that the machine is locked into adjustment for all successive operations upon that stock size. When it is desired to set the machine for new paper stock, the cams 98 are set back to their home positions and the cycle is repeated with the new paper stock.

Figure 1:
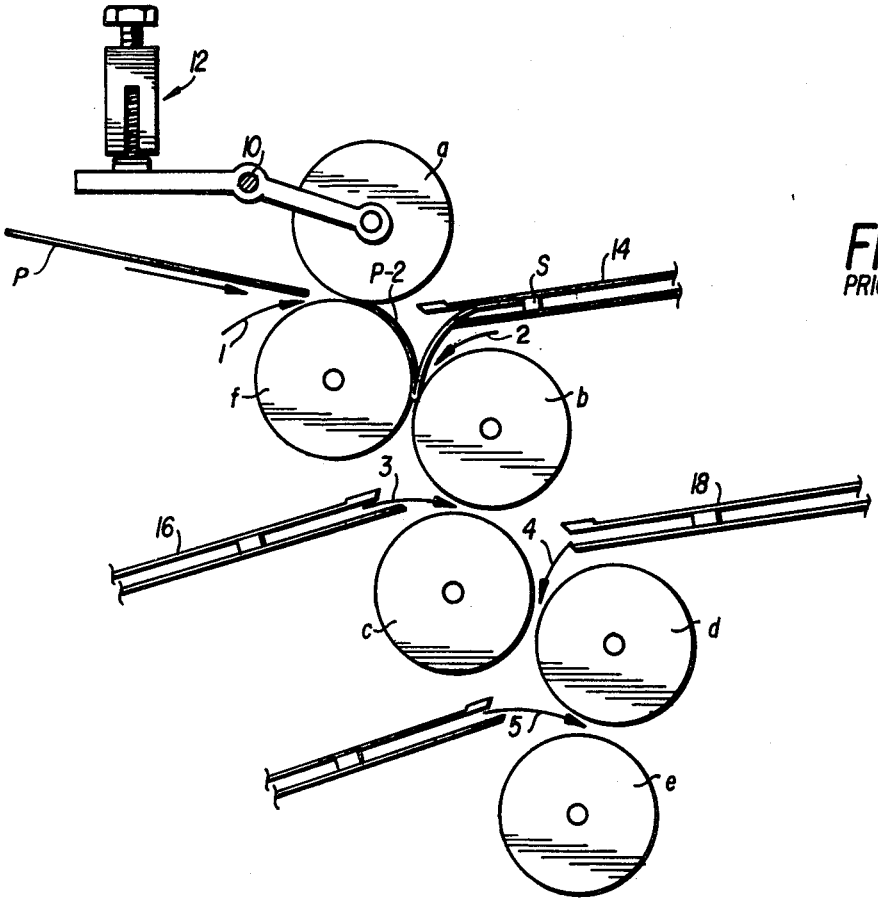
FIG. 1 PRIOR ART
FIG. 1 is a schematic illustration of a conventional buckle folder.
Figure 7:
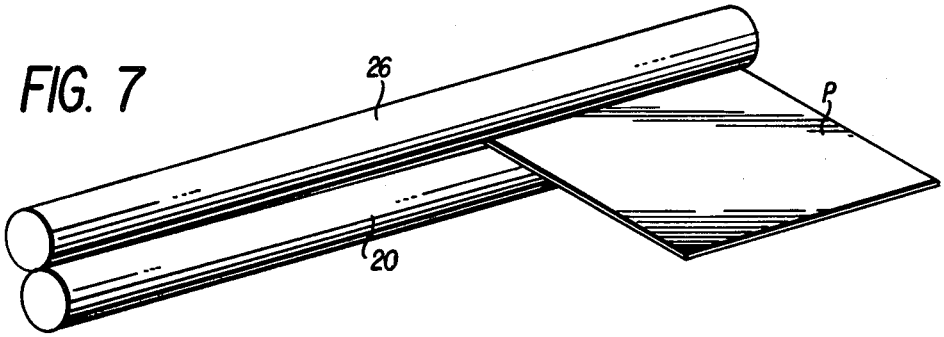
FIG. 7 is a schematic pictorial view of a relatively narrow piece of paper being fed between two rollers.

As noted above, one of the advantages of the above described structure lies in its ability to have opposite roller ends automatically adjusted to accommodate stock that is more narrow than the folder's maximum stock width. As shown in FIG. 7, for example, when a piece of stock P is fed between two rollers, schematically illustrated as 26 and 20 the left ends of the rollers in FIG. 7 are in contact with each other, but the right ends are spaced in accordance with the stock thickness. The structure just described automatically adjusts for this, however, by merely permitting less roller motion on the left side than on the right. Similarly, if a somewhat wider piece of stock is fed into the folder, the right side would be adjusted to the full thickness of the stock (or perhaps a bit more); and, the left side, although not at a minimum dimension, would nevertheless be spaced more closely than the right.

Figure 8:
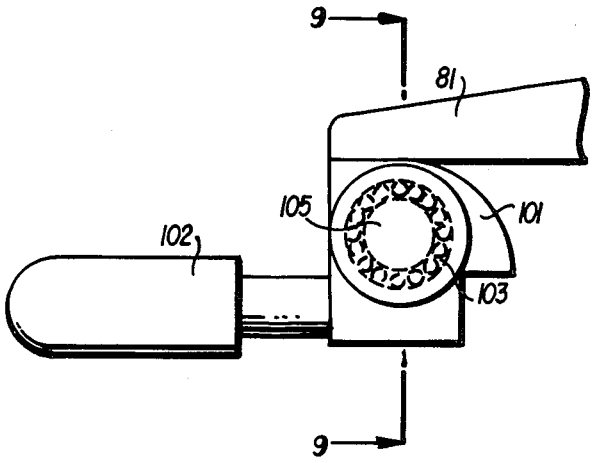
FIG. 8 is a plan view of a cam portion of another embodiment of this invention.
Figure 9:
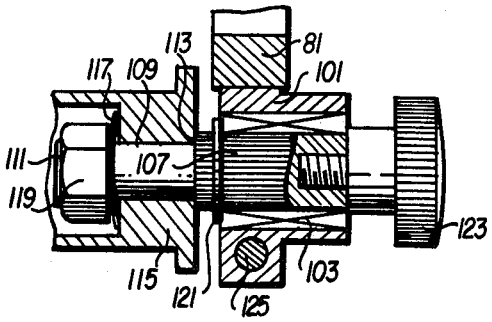
FIG. 9 is a partially sectional view taken on line 9—9 in FIG. 8.
Figure 10:
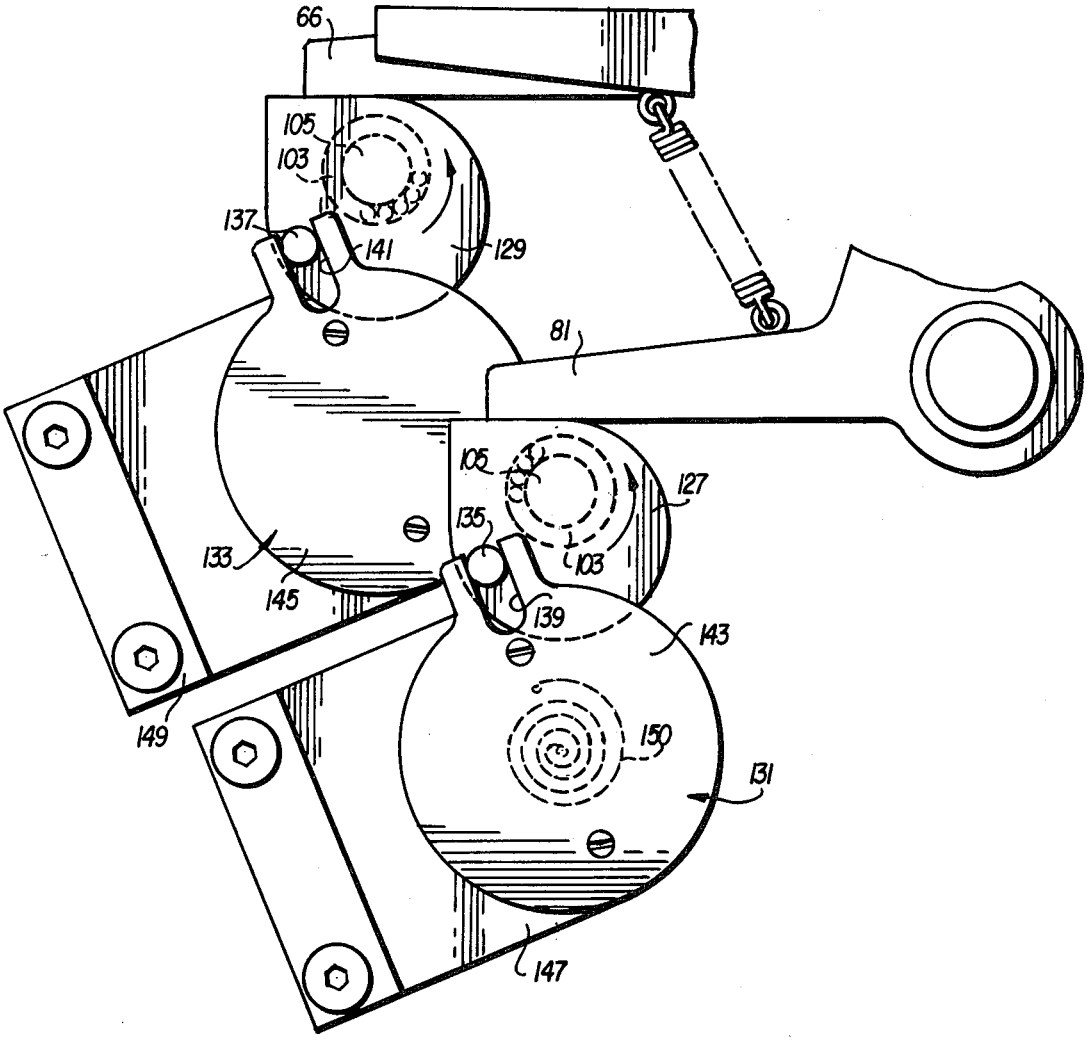
FIG. 10 is a plan view of a cam portion of an automatic resetting and locking mechanism to be used in another embodiment of this invention.

The above described structure, although providing automatic adjustment of roller spacing, requires manual operation in that the cams 98 must be manually loosened and reset to "home" positions before adjustment and thereafter tightened once the cams are in proper positions. FIGS. 8 and 9 depict another cam-operating structure which also allows manual operation, but which can be adapted for automatic actuation of the cams as is depicted in FIG. 10 and described below. FIGS. 8 and 9 depict a cam 101, equivalent to cam 98-4 shown in FIG. 6, controlling the position of the first lever arm 81 of the system shown in FIG. 6.

The cam 101 is mounted on a "Torrington" drawn-cup roller clutch (a one-way roller clutch bearing) 103, which is depicted schematically in FIGS. 8 and 9. This type of clutch bearing is described in the Torrington Company Catalog RC-6 (1969). The one-way clutch bearing 103 allows counterclockwise rotation of the cam 101, but does not allow clockwise rotation thereof. Any type of one-way mechanism can be used therefor, including a ratchet-type mechanism, however, it must have very little "slop" in the clockwise direction.

The bearing 103 is mounted on a stud 105 which includes an enlarged portion 107, (FIG. 9) a shank 109, and a threaded end 111. The enlarged portion 107 has shoulders 113 which abut against a frame 115 and the shank 109 is journalled into the frame 115. An elastic washer 117 is placed over the threaded end 111 and a nut 119 is screwed onto the threaded end 111 to load the elastic washer 117 against the frame 115. The bearing 103 is loaded between a retaining ring 121, positioned in a slot in the enlarged portion 107, and a knob 123 which is screwed into the end of the enlarged portion 107.

A circle 125 depicted in FIG. 9 represents a threaded portion of the weighted arm member 102 which is screwed into the cam 101.

In operation of the FIGS. 8 and 9 apparatus, when the first lever arm 81 moves upwardly so that its contoured surface 82 (FIG. 6) can follow a movement of the movable roller 30, as was described above, the weighted handle 102 causes the cam 101 to move in a counterclockwise direction as viewed in FIG. 8 so that a larger portion of the cam continues to contact the first lever arm 81. The one-way bearing 103 does not allow clockwise rotation so that once the first lever arm 81 achieves its position of furthest movement, the cam 101 is locked in position. The position of the contour 82 (FIG. 6) is thus set by the one-way bearing 103 and the spring mechanism 38 (FIG. 6). When it is desired to set the cam 101 back to its home position of FIG. 8, the knob 23 is manually gripped and rotated in a clockwise rotation with sufficient torque to overcome the elastic washer 117 and thereby turn the whole shaft 105 in the frame 115. The cycle can then be repeated for automatically setting the position of the first lever arm 81.

A further mechanism for automating the operation of the setting cams is depicted in FIG. 10. Here the cams 127 and 129 do not have handles but rather are driven by rotary solenoids 131 and 133. In this respect, the cams are mounted the same as the cams of FIGS. 8 and 9, that is, with one-way bearings 103 and shafts 105 loaded in a frame by an elastic washer 117. The cams 127 and 129 have mounted thereon studs 135 and 137. The studs 135 and 137 are held in slots 139 and 141 of actuator discs 143 and 145 of the rotary solenoids 131 and 133. In this respect, all that is shown of the rotary solenoids are the actuator discs 143 and 145 for the sake of simplicity. The rotary solenoids are mounted to a frame by brackets 147 and 149. The rotary solenoids have stops which allow 45 degrees of movement in a clockwise direction from the positions of FIG. 10. The rotary solenoids are spring loaded by spring 150 (one shown) to rotate in a clockwise direction but can be electrically energized to rotate in a counterclockwise direction. In this respect, the solenoids can be energized at two levels, one of which simply applies pressure on the studs 135 and 137 which is insufficient to actually overcome the loading of elastic washer 117 of FIG. 9 and thereby rotate the cam-mounting studs 105 in a clockwise direction; and the other level of energization is sufficient to overcome the loading of the elastic washer and thereby rotate the cams in clockwise directions by rotating the cam-mounting studs 105.

The sequence of operation for a cycle of setting one movable roller is as follows:

Paper stock pressing between the movable roller 30 and the fixed roller 22 (FIG. 6), for example, causes movement of the first lever arm 81 as viewed in FIG.

10. Spring loading of the rotary solenoid 131 causes the actuator disc 143 to rotate in a clockwise direction and thereby rotate the cam 127 in a counterclockwise direction. Once the first lever arm 81 has found its proper position to set the spacing for the paper stock, the spring 150 of the rotary solenoid 131 can no longer rotate the cam 127. The rotary solenoid 131 is now electrically energized at its lower level to apply a small counterclockwise torque to the actuator disc 143 and a clockwise force to the cam 127. Cam 127, however, is not free to rotate in the clockwise direction because the one-way clutch bearing 103 does not allow such rotation thus, cam 127 is thereby locked in this position. Now when it is desired to reset the cam 127 back to its home position as viewed in FIG. 10, for setting the roller spacing for another paper stock, the rotary solenoid 131 is electrically energized to its higher level of energization which is sufficient to overcome the frictional force on the stud 105 caused by the elastic washer 117. Thus, the cam 127 and its shaft 105 are rotated in a clockwise direction to their home positions of FIG. 10.

Figure 11:
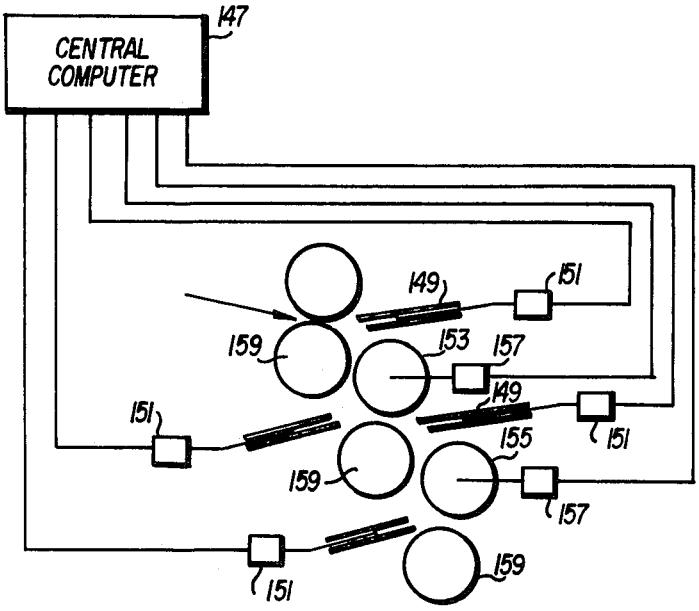
FIG. 11 is a schematic block diagram of an overall automatic system employing the mechanism of the FIG. 10 embodiment.

An application of the above described fully-automatic roller setting mechanism is with a folding machine of the type depicted in FIG. 11 wherein a central computer 147 controls the positions of stop members 149 via stopped-member actuators 151 and the spacing positions of movable rollers 153 and 155 via movable roller actuators 157. The movable roller actuators 157 are depicted schematically only in FIG. 11 but are depicted and described in detail in relation to FIG. 10.

In operation of the system of FIG. 11, an operator must merely provide the central computer 147 with an indication of the types of folds that are desired. The central computer 147 then adjusts all of the fold pans and resets all of the movable roller actuators 157 back to home positions, which are shown in more detail in FIG. 10. A test piece of paper stock is then run through the rollers to move the movable rollers 153 and 155 from fixed rollers 159. As the movable rollers 155 and 157 are moved from the fixed rollers 159 appropriate spacing distances, the movable-roller actuators 157 — that is the cams 127 and 129 of FIG. 10 — hold the movable rollers in their appropriate positions. The central computer 147 then places a lower-level energization signal on the movable-roller actuators 157 to lock the positions of the movable rollers 153 and 155 in these positions. The machine is then ready for a full scale folding run. Hence, all of the fold pan and roller adjustments are made automatically without any operator intervention.

While the invention has been particularly shown and described with reference to a preferred embodiment thereof, it will be understood by those skilled in the art that various changes in form and detail may be made therein without departing from the spirit and scope of the invention. For example, although five nip-spaces and six rollers have been illustrated, different numbers of rollers can be used as well. Also, although the invention is illustrated as being embodied in a particular type of buckle folder, the invention can be otherwise embodied.

The embodiments of the invention in which an exclusive property or privilege is claimed are defined as follows:

We claim:

1. In a folding machine of the type comprising at least two fixed rollers and one adjustable roller, the adjustable roller being movable substantially concentrically about at least one of said fixed rollers during the setting of the spacing between the other of said fixed rollers and the adjustable roller, the improvement comprising:

an adjustable-roller shaft for supporting said adjustable roller;

contoured elements affixed to opposite ends of said adjustable roller shaft;

contoured surfaces independent of said at least one of said fixed rollers mounted adjacent said contoured elements with said contoured elements at the ends of said adjustable-roller shaft being supported by, but movable about said contoured surfaces, said contoured surfaces being curved in shape and being substantially concentric with said at least one of said fixed rollers, said motion of said adjustable roller about said contoured surfaces during the setting of said spacing with respect to said other fixed roller being thereby substantially concentric about the axis of said one fixed roller; and biasing means for biasing said adjustable roller shaft and said contoured elements toward said contoured surfaces.

2. In a folding machine as in claim 1 wherein said contoured surfaces are substantially round and are movable toward and away from the axis of said one fixed roller.

3. In a folding machine as in claim 2 wherein is further included a contoured-surface control means to control the positions of the contoured surfaces.

4. In a folding machine as in claim 2 including levers and wherein said contoured surfaces are affixed to a first arm thereof, said levers pivoting about the axis of said other fixed roller.

5. In a folding machine as in claim 4 including contoured-surface control means to control the positions of the contoured surfaces wherein said levers have second arms and said contoured-surface control means are in engagement with said second arms.

6. In a folding machine as in claim 5 wherein said contoured-surface control means comprises cams which impinge on said second arms.

7. In a folding machine as in claim 6 wherein said cams are biased to follow movement of said second arms as said contoured surfaces move away from the axis of said one fixed roller.

8. In a folding machine as in claim 7 wherein is further included a setting means for selectively loosening said cams for movement, and setting said cams against movement.

9. In the folding machine of claim 1 wherein the adjustable roller is also movable substantially concentrically about said other fixed roller during the setting of spacing between said one fixed roller and the adjustable roller including:

second contoured elements also affixed to opposite ends of said adjustable roller shaft;

second contoured surfaces independent of said other fixed roller mounted adjacent said second contoured elements with said second contoured elements at the ends of said adjustable-roller shaft being supported by, but movable about said second contoured surfaces, said second contoured surfaces being curved and being substantially concentric with said other fixed roller, said motion of said adjustable roller about said contoured surfaces with respect to said one fixed roller being thereby substantially concentric about the axis of said other roller; and wherein said biasing means also biases said adjustable roller shaft and said second contoured elements toward said second contoured surfaces.

10. A folding machine in which the spacing between rollers can be set to accommodate paper stock of various thicknesses, said folding machine comprising:

at least two fixed rollers;

at least one adjustable roller, the position of which is adjustable relative to at least one of said fixed rollers along an arc that is substantially concentric about the other roller to obtain an adjusted spacing between said one fixed roller and the adjustable roller;

an adjustable roller setting means for supporting said adjustable roller and causing said adjustable roller to move away from said one fixed roller along said arc in response to paper travelling through nips formed between said one fixed roller and said adjustable roller said adjustable roller setting means having the further function of automatically and simultaneously maintaining said adjusted spacing.

11. A folding machine as in claim 10 including means for also moving said adjustable roller with respect to said other fixed roller along an arc that is substantially concentric about said one fixed roller.

12. A folding machine as in claim 10 wherein said adjustable roller includes an adjustable roller shaft and contoured elements affixed to opposite ends of said adjustable roller shaft, said machine further including contoured surfaces independent of said other roller mounted adjacent said contoured elements with said contoured elements at the ends of said adjustable-roller shaft being supported by, but movable about said contoured surfaces, said contoured surfaces being substantially round in shape and being substantially concentric with said other roller, said motion of said adjustable roller about said contoured surfaces with respect to said one fixed roller being thereby substantially concentric about the axis of said other roller.

13. A folding machine as in claim 12 wherein said contoured-surface elements are located on first arms of levers, said levers being pivotable about the axis of said one fixed roller.

14. A folding machine as in claim 13 wherein said levers have second arms and wherein are further included contoured-surface control means linked to said second arms.

15. A folding machine as in claim 14 wherein said contoured surface control means comprise cams which impinge on said second arms.

16. A folding machine as in claim 15 wherein said cams are biased to follow movement of said second arms as said contoured surfaces move away from the axes of said fixed rollers.

17. A folding machine as in claim 16 wherein is further included a setting means for selectively loosening said cams for movement, and setting said cams against movement.

18. A method for setting the roller spacing between an adjustable roller and first and second fixed rollers in a folding machine, said method comprising the steps of:

biasing said adjustable roller toward said first and second fixed rollers so as to form first and second nips between said adjustable roller and said first and second fixed rollers, but allowing said adjustable roller freedom of movement to move away from said first and second fixed rollers on paths that are substantially concentric with the axes of said first and second fixed rollers;

feeding paper stock through said first nip so as to force said adjustable roller away from said first fixed roller a distance equal to the thickness of said paper stock;

mounting said adjustable roller on a support mechanism which simultaneously and automatically, with the feeding of said paper stock through said first nip, maintains the position of said adjustable roller relative to said first fixed roller to set the space between said adjustable roller and said first fixed roller, but allowing said adjustable roller freedom of movement away from said second fixed roller on said path that is substantially concentric with said first fixed roller;

feeding said paper stock into said second nip so as to force said adjustable roller away from said second roller on said path that is substantially concentric about said first roller by a distance equal to the thickness of said paper stock in said second nip; and, mounting said adjustable roller on a support mechanism which simultaneously and automatically, with the feeding of said paper stock through said second nip, maintains the position of said adjustable roller relative to said second fixed roller to set the space between said adjustable roller and said fixed roller.

* * * * *